US009241864B2

(12) United States Patent
Miller

(10) Patent No.: US 9,241,864 B2
(45) Date of Patent: Jan. 26, 2016

(54) FOLDABLE WALKING STABILIZER DEVICE

(71) Applicant: Jonathan Jay Miller, Skokie, IL (US)

(72) Inventor: Jonathan Jay Miller, Skokie, IL (US)

(73) Assignee: Jonathan Jay Miller, Skokie, IL (US)

( * ) Notice: Subject to any disclaimer, the term of this patent is extended or adjusted under 35 U.S.C. 154(b) by 0 days.

(21) Appl. No.: 14/347,975

(22) PCT Filed: Sep. 28, 2012

(86) PCT No.: PCT/US2012/058064

§ 371 (c)(1),
(2) Date: Mar. 27, 2014

(87) PCT Pub. No.: WO2013/052382

PCT Pub. Date: Apr. 11, 2013

(65) Prior Publication Data

US 2014/0319792 A1 Oct. 30, 2014

Related U.S. Application Data

(60) Provisional application No. 61/542,660, filed on Oct. 3, 2011.

(51) Int. Cl.
*A61H 3/04* (2006.01)

(52) U.S. Cl.
CPC ..... *A61H 3/04* (2013.01); *A61H 2003/046* (2013.01); *A61H 2201/0161* (2013.01); *A61H 2201/1633* (2013.01)

(58) Field of Classification Search
CPC ..... A61G 5/06; A61G 5/08; A61H 3/04; A61H 3/046
USPC ..... 280/638, 639, 38, 647, 650, 657, 280/87.021, 87.041, 87.051
See application file for complete search history.

(56) References Cited

U.S. PATENT DOCUMENTS

| | | | | | |
|---|---|---|---|---|---|
| 1,895,150 | A * | 1/1933 | Darnell | B60B 33/021 | 16/35 R |
| 4,322,093 | A * | 3/1982 | Otto | A61G 5/00 | 188/2 F |
| 5,538,268 | A * | 7/1996 | Miller | A61H 3/04 | 280/87.041 |
| 5,575,294 | A * | 11/1996 | Perry | A45B 3/00 | 362/102 |
| 6,428,020 | B1 * | 8/2002 | Steadman | A61G 5/06 | 280/47.25 |
| 2002/0070533 | A1 * | 6/2002 | Owens | A61H 3/04 | 280/650 |
| 2007/0013158 | A1 * | 1/2007 | Loniello | A61H 3/04 | 280/87.021 |

* cited by examiner

*Primary Examiner* — John Walters
(74) *Attorney, Agent, or Firm* — James Faier; Faier & Faier P.C.; Martin Faier

(57) ABSTRACT

A foldable walking stabilizer device for a disabled person having a U-shaped base with caster assemblies on each leg of the base and upright members extending from the base, the upright members having brake assemblies normally preventing the caster assemblies to move and adapted to release the casters for movement on manipulation of the brake assemblies, wherein the brake assemblies have an adjustable tension control associated with the caster assemblies for permitting a user to slow down or speed up walking movement. The invention also discloses a fulcrum device on the base which permits the user to lift the device over curbs and similar obstructions, as well as improved folding mechanism which permits the device to be conveniently collapsed by the user for storage and transport.

17 Claims, 8 Drawing Sheets

FOLDABLE WALKING STABILIZER DEVICE

Priority in this application is based on Provisional Patent Application Ser. No. 61/542,660, filed Oct. 3, 2011.

BACKGROUND AND SUMMARY OF THE INVENTION

This invention relates to improvements in a foldable walking stabilizer device, and is particularly concerned with improvements for controlling movement of such a device by a disabled person. Such improvements include novel means for the user to lift the device over curbs and similar obstructions. The improvements also include novel arrangements of components of the stabilizer device in a more usable and convenient position for the user and more secure and safer for the user in that the device is locked in position unless the user continually activates the unit for movement. Other improvements include new and novel structure for making the device easier and more convenient for folding and transportation.

Specifically, these improvements consist of

1. Providing an adjustable side tension control for slowing down the walker device by rotating a convenient lever which causes frictional engagement of structure on the main wheels of the stabilizer device, thus permitting the user to slow down or speed up walking movement.

2. Adding a rear press down frame on the device available to the user which can be easily manipulated for going over curbs and similar obstructions.

3. Upgrading the spring loaded front caster on the device to improve its function and adjustability so that the stabilizer can traverse larger obstacles.

4. Providing a central junction box on the device to reduce the length and complexity of control cables and to provide a convenient position for a laser cueing product, which enhances movement by the disabled person without fear or hesitation.

5. Arranging an adjustable back rest which allows convenient use for people of different sizes, postures and disabilities, particularly for a user who has become exhausted.

6. Devising an improved fold up means, making folding easier with better functionality and with simple release means operable with one hand and minimum effort, without excessive bending or uncomfortable movement by the user.

7. Having a convertible brake bar means for a disable person to operate by means of a centrally located pivotally rockable bar, without having to rely upon just the hand brakes which require the ability to press them for operation.

These and other improvements will become more apparent as this description proceeds, taking in conjunction with the accompanying drawings or photographs.

PRIOR ART

Foldable walking stabilizer devices for physically disabled persons or walkers are known in the prior art. Such a device is shown in applicant's prior U.S. Pat. No. 5,538,258 granted Jul. 23, 1996 which is relevant to the present invention inasmuch as the improvements disclosed in this application may be incorporated into a modified and improved device. Additionally, applicant's prior U.S. Pat. No. 7,484,740 teaches a laser cueing device and associated equipment of a kind which can be modified for use, improved and incorporated into a walking stabilizer embodying the improvements disclosed in the present application.

BRIEF DESCRIPTION OF THE ACCOMPANYING DRAWINGS

DESCRIPTION OF PREFERRED EMBODIMENTS

Figure 1:
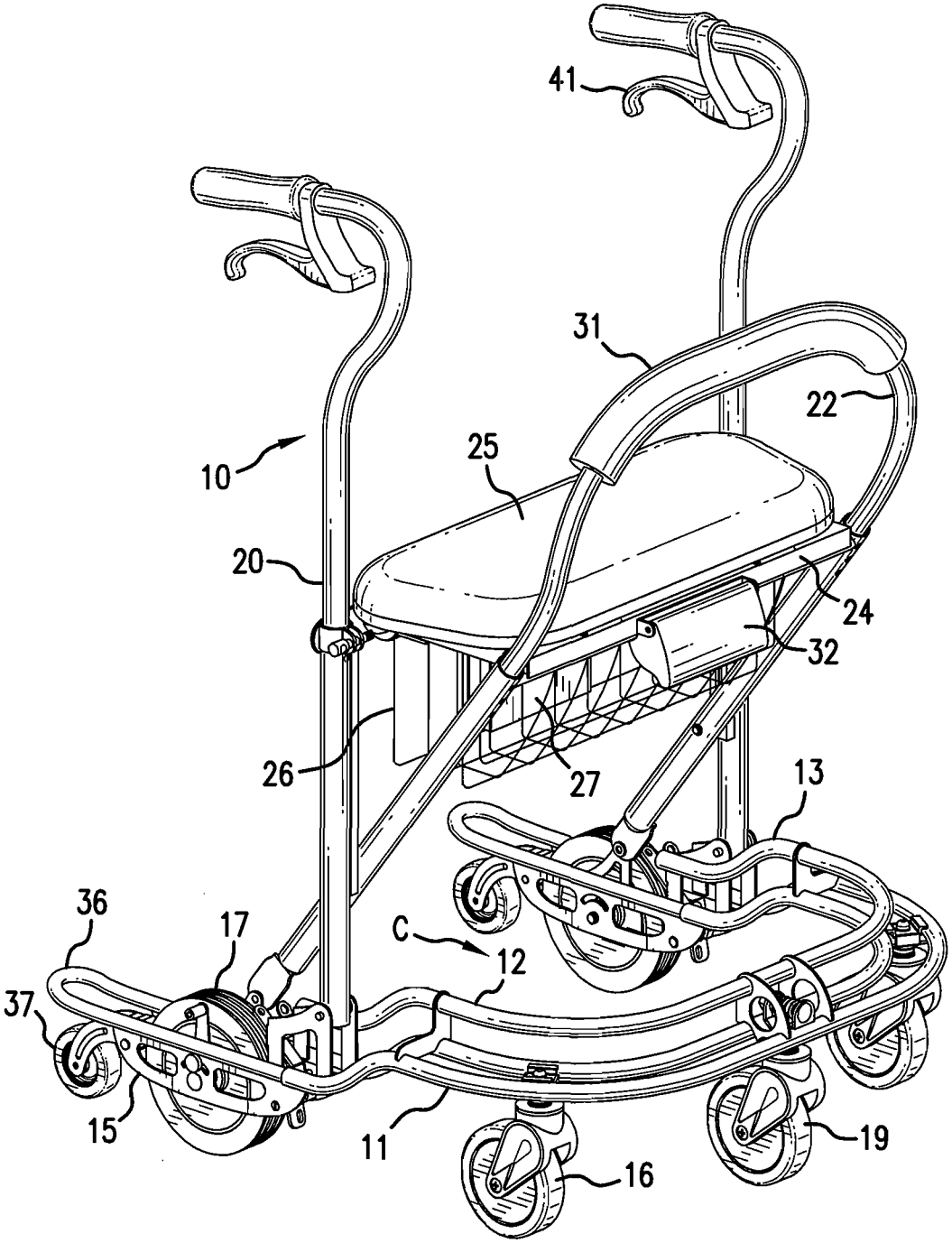
FIG. 1 is a perspective view showing one version of the device in operable position.

With reference to FIG. 1, the walking stabilizer device 10 embodying the present improvements comprises a U shaped base 11 having spaced apart tubular members 12, and opposed upright supports 20 pivotally secured on the base 11. Secured on opposed side walls 15 of a frame 13 associated with the base 11 are large rotatable wheel assemblies 16. Articulatable caster assemblies 17 are arranged on the base 11 substantially surrounding a user and bridging the base tubular members 12 on rear side of each wheel assembly 16. Centrally of the base 11 is a spring loaded central caster 19. The upright support members 20 are tubular and are telescopic and adapted to be adjusted in height to accommodate a user. A hand brake lever 41 may be provided at the distal end of each of the spaced apart upright support members 20.

In the mode of the device 10 shown in FIG. 1, a U shaped upright bar 22 having its free ends pivotally connected to the U shaped base 11 stabilize the unit. Bridging the upright bar 22 about midway their height may be a horizontal cross bar 24 and another cross bar 24*a* which may carry a seat 25 and a basket 26.

A central junction box 27 houses and connects cables which extend from the hand brakes 41. These cables 28 are connected to the upright supports 20 (shown in FIGS. 7A and 7B) and the cables are connected from the junction box 27 to the large articulatable caster assemblies 17. A laser cueing device of the kind disclosed in U.S. Pat. No. 7,484,740 also may be mounted in the junction box 27 in a position to direct a laser beam downward to within the area C of U shaped base 11. for cueing the user's movement.

Figure 3:
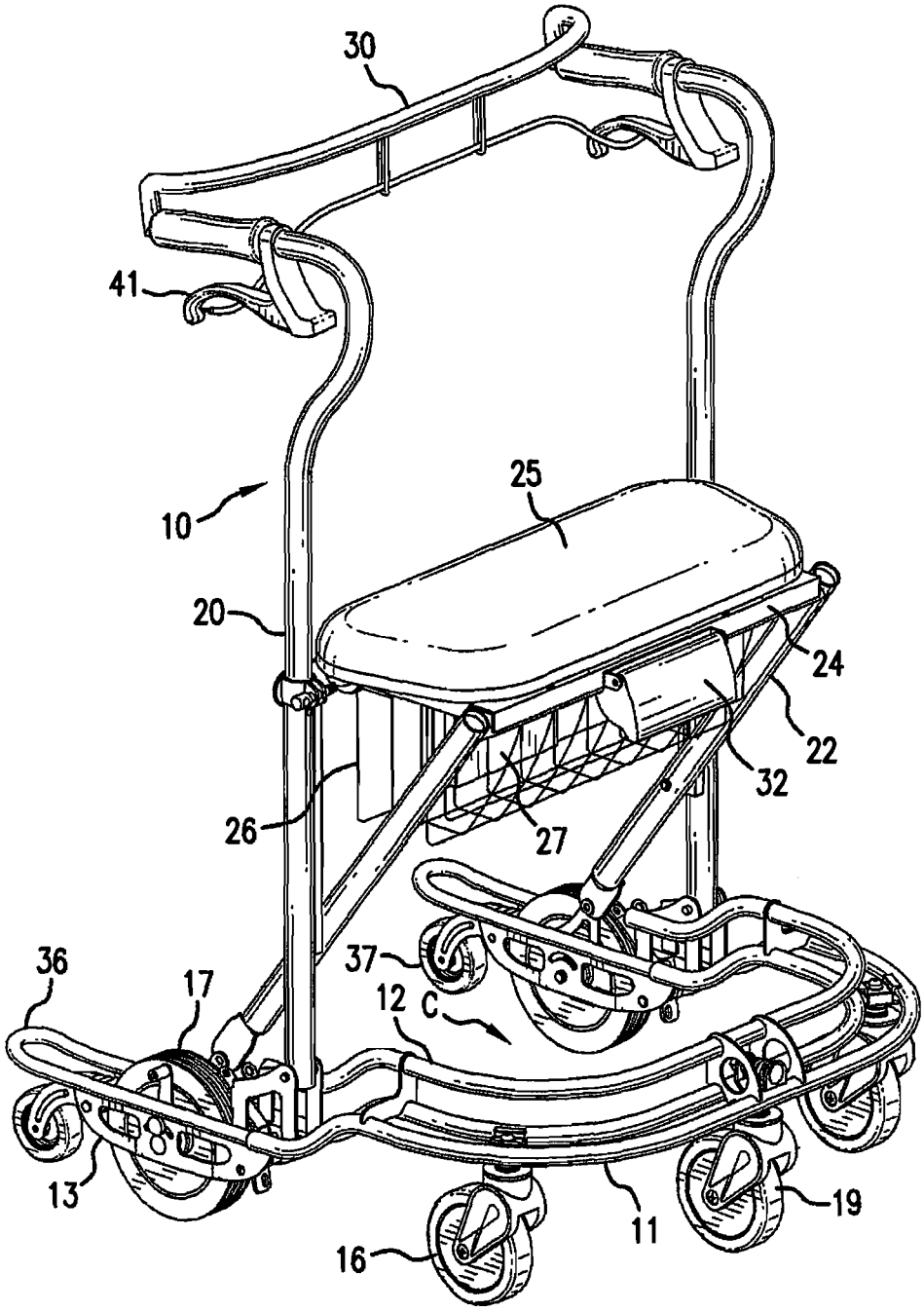
FIG. 3 is a perspective view showing a modified version of the device having a brake bar and modified seat arrangement.

In the mode of the device 10 shown in FIG. 3, a brake bar 30 spans and is rockably pivotally secured to the spaced apart upright supports 20 and between the brake levers 41. This brake bar 30 is connected through the levers 41 along the upright supports 20 to the junction box 27 and from the junction box to the articulatable caster assemblies 17 in the same manner as the brake levers 41 (cable 28 connections shown in FIGS. 7A and 7B). In this mode the backrest member 31 connected on the U shaped upright bar 22 shown in FIG. 1 may be removed to permit the user, facing forward, to sit on the walker device seat 25.

Figure 2:
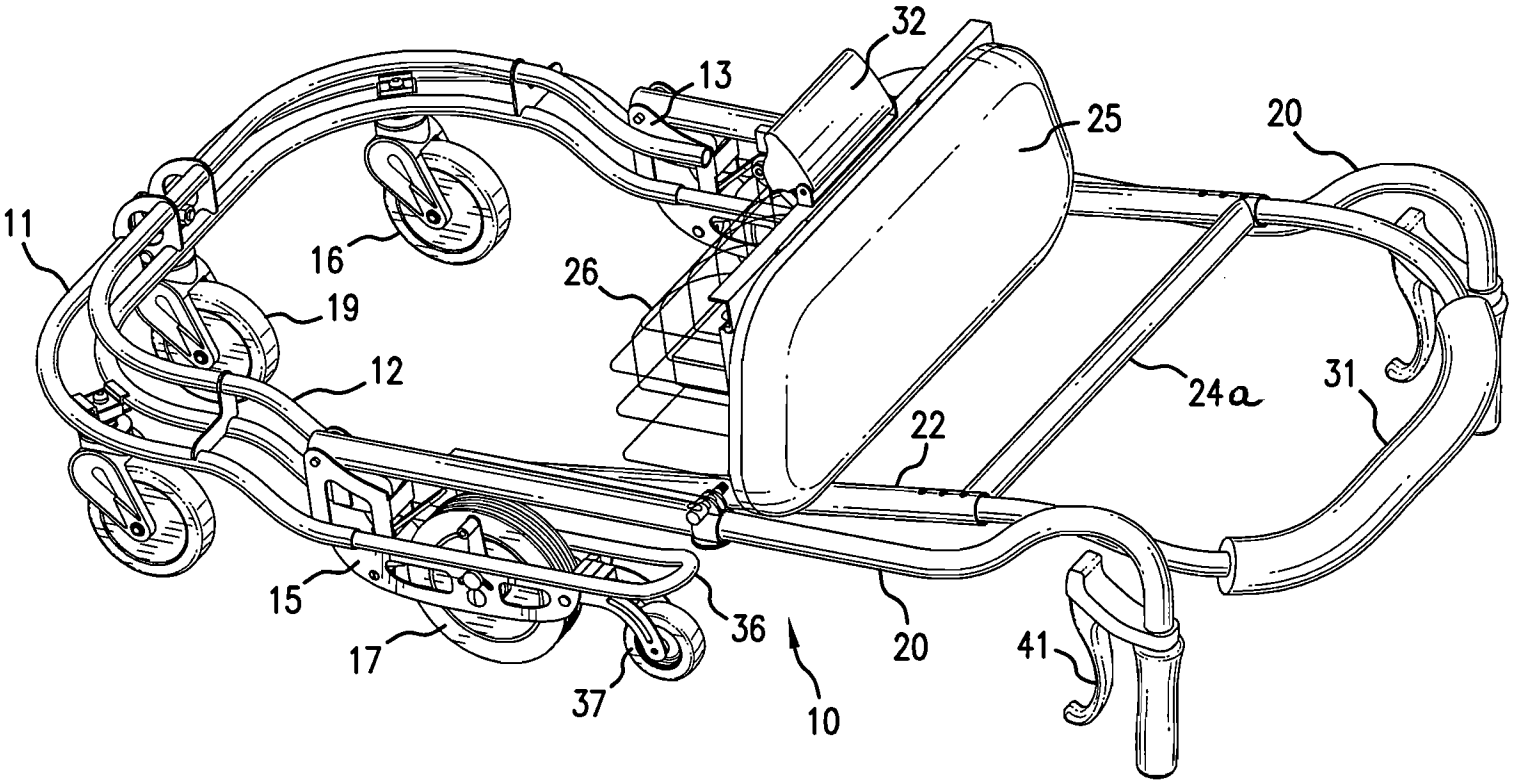
FIG. 2 is a perspective view showing the version of the device appearing in FIG. 1 in folded position for transport or storage.
Figure 2C:
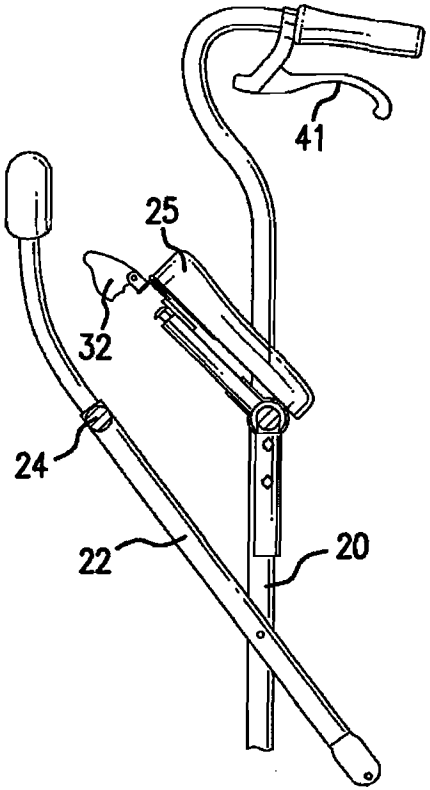
FIGS. 2A, 2B and 2C show the steps for folding the devise from the position shown in FIG. 1 to the position shown in FIG. 2.
Figure 2B:
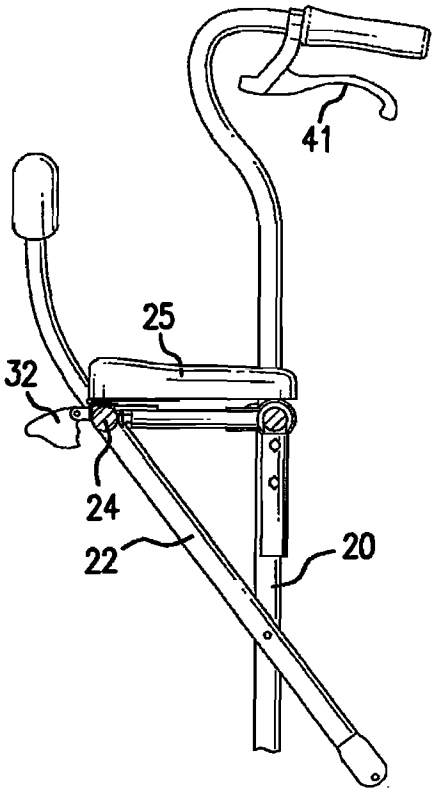
Figure 2A:
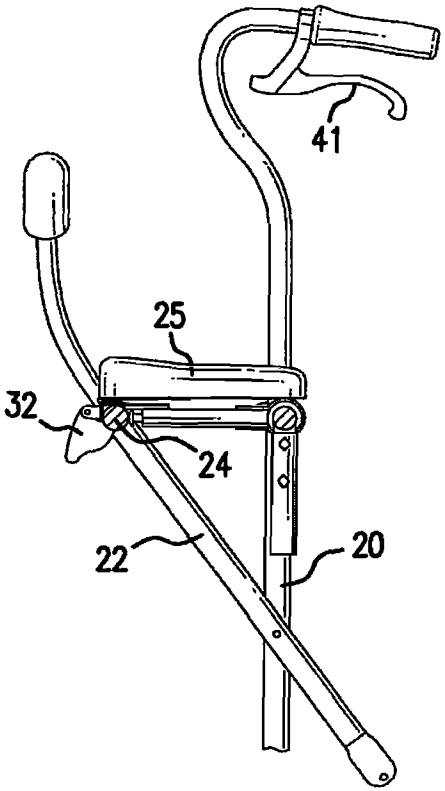

As seen if FIG. 2, the walking stabilizer device 10 may be folded for storage and transport. This folding operation is easily accomplished with one hand by lifting up a hand release 32 on the front of the horizontal cross bar 24 adjacent the seat 25 until the seat flips up. The mid-level horizontal cross bar is pulled up until the upright supports 20 and the U shaped upright bar are aligned against one another as shown in FIG. 2. Unfolding is also easily accomplished by lifting the horizontal cross bar 24 on the U shaped upright bar 22 which cause the unit to unfold until the hand release 32 is re-engaged when the seat 25 is in proper position. This fold up structure permits the unit to be folded or unfolded without having to bend down to lift it or to collapse the device. 28. An alternative device is shown in FIG. 3, which is substantially like the FIG. 1 device, except there is a bridging brake bar 30 extending horizontally between the hand brakes 41 on the upright supports 20. This bridging brake bar 30 is pivotally rockably connected to the end of each upright support 20 and the cables 28 and when rocked may engage or disengage the braking system without the need to manipulate the hand brakes 41. In this embodiment, the U shaped bar does not extend above the seat 25 and is set at substantially the height of the seat, so that a user can go to the front side of the device and use the seat 25 for support.

Figure 4:
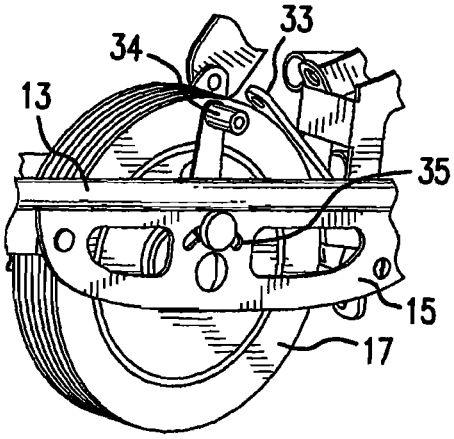
FIG. 4 is a detail view of the tension control on an articulatable caster assembly for controlling and adjusting movement of the device.

With reference to FIG. 4, friction tensioning means 33 for the side articulately caster assemblies 17 is shown. The friction tensioning means 33 comprises an aligned friction device arranged adjacent to the caster 17 and adjustable lever means 34 arranged in an arcuate slot 35 on the frame 13 for moving the caster toward or away from the friction tensioning means 33 to increase or reduce tension on the caster to regulate and control resistance movement of the walking stabilizer 10.

Figure 5:
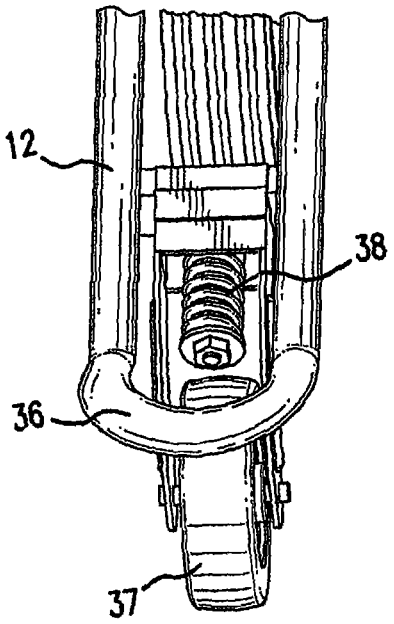
FIG. 5 is a detail view of the rear press down frame for rocking the device to maneuver it over a curb or other obstacle.

The press down rear frame portion 36 shown in FIG. 5 permits the walking stabilizer 10 to be lifted when depressed fulcrum-like to manipulate the stabilizer over curbs and similar obstructions. By pressing down on this frame portion 36, where the tubular members 12 are bent upwardly from the remainder of the frame 13, the front of the walking stabilizer will lift to permit it to clear the curb or other obstruction. After the curb or obstruction has been cleared, the user removes his foot from the press down frame portion 36 and the stabilizer 10 can move forward on a level surface. Greater or lessened tension can be applied to the rear wheel 37 below the press down frame portion 36 by adjusting the rear wheel spring 38 on the wheel, which affects the tension of the lifting action in manipulating obstructions.

Figure 6:
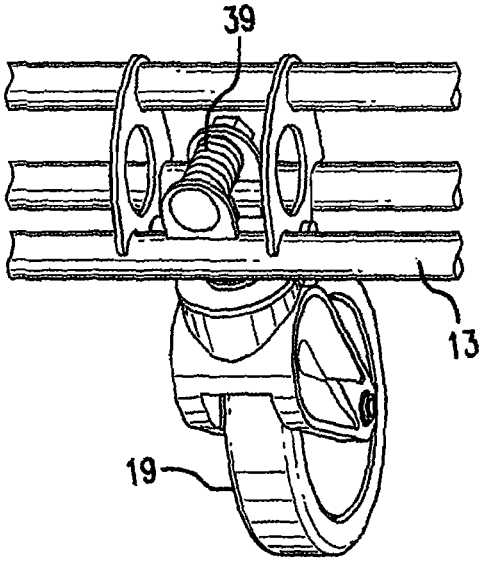
FIG. 6 is detail view of the adjustable spring loaded tensioning structure for the front central caster.

A spring loaded central caster 19 is provided on the front of the frame 13, and this caster assembly may be tensioned or loosened by adjustment of its associated central caster compression spring 39, as depicted in FIG. 6, which is easy to adjust.

Figure 7:
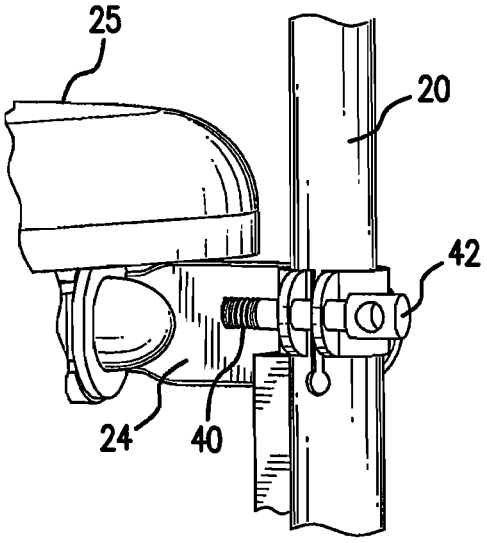
FIG. 7 is a detail view of a upright support and seat adjustment assembly, part of the upright support being broken away.

Height of the seat 25 and the telescoped upright supports 20 can be adjust by use of the adjustment device 40 shown in FIG. 7, which may be raised or lower as desired, and this device also permits tightening of the cross bar 24 to make the walking stabilizer structure rigid by adjusting the threaded post 42 relative to the upright supports 20 and the cross bar 24.

Figure 7B:
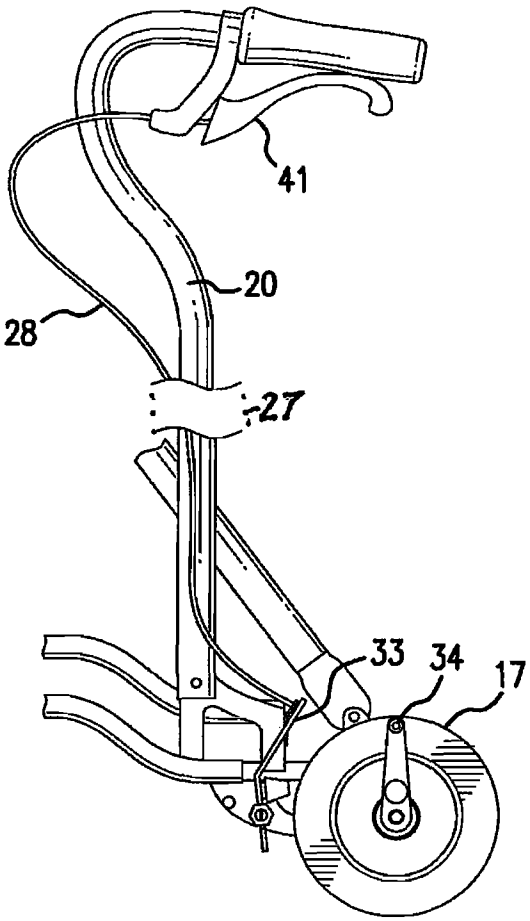
FIGS. 7A and 7B show the cable connection from the hand brake to the large wheel for locking the device from movement or allowing movement, depending upon whether the hand brake lever is free or depressed, respectively.
Figure 7A:
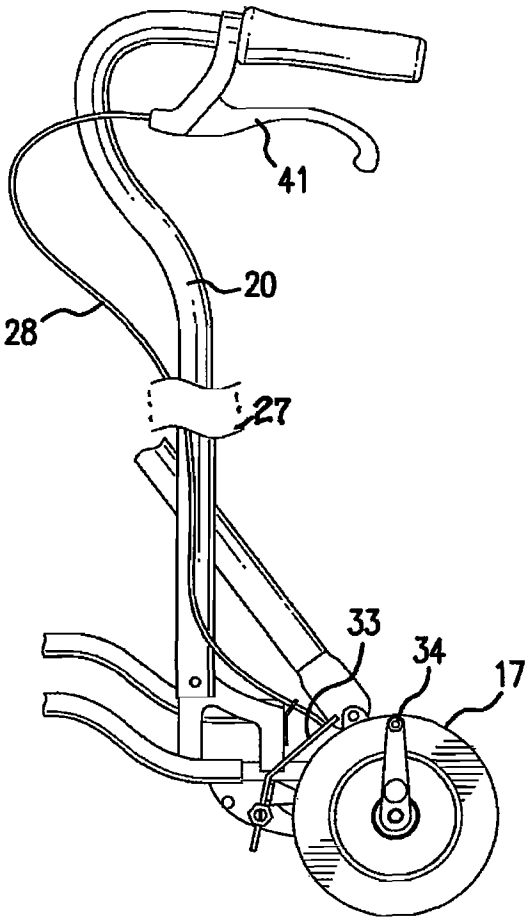

The hand brake lever 41 shown in FIGS. 7A and 7B, respectively, which may be associated with the brake bar 30 depicted in FIG. 3 of the modified device, pulls or loosens cables 28 arranged along the upright supports 20, as described. These cables 28 and the brake level 41 or bar 30 are always under tension by pressing the tensioning device 33 against the caster 17 as shown in FIG. 7A, until and unless released by the user either by pressing on the hand brakes 41 or manipulating the brake bar 30 as shown in FIG. 7B. The walking stabilizer cannot be moved until and unless the tension on the cables is released by manipulating the brake lever 41 or the brake bar 30, so that the walking stabilizer 10 will not move unintentionally and perhaps cause an injuring to the user. The cables 28 extend through the upright supports 20 to the junction box 27 carried by the horizontal cross bar 24, and from this junction box 27, the cables 28 extend to the articulatable caster assemblies 17. The upright supports 20 neatly hold the cables 28 and inhibits undesirable adjustments by the user and others and further lessens the possibility of unintended interference with or damage to the cables.

As part of the junction box 27, there may be provided structure for a laser cueing device in a position directed from the junction box downward to the center area C of the walking stabilizer 10, making it easier for the user to follow walking cues emitted by the laser cueing device. The laser module can be programmed to turn on automatically by just starting to walk, and may be timed to turn off if the stabilizer device is not moving.

While substantial disclosure has been made of the preferred embodiment improvements in the present walking stabilizer, it should be understood that it is not intended that the invention should be limited to the exact structure disclosed as many variations in the structure can be made without departing from the spirit or scope of the invention. Accordingly, the invention should not be limited, except as limitations in the claims for this invention are made.

The invention claimed is:

1. A walking stabilizer device to assist movement of a physically disabled user, said device comprising:

a U-shaped base wheel assemblies secured on said base rotatable responsive to movement of said device by said disabled person, a plurality of caster assemblies secured on opposed legs of said base for rotation in said base said caster assemblies arranged in line with said wheel assemblies in the direction of movement of said wheel assemblies, a right-side upright member and a left-side upright member each extending from said base above each of said caster assemblies, brake means on at least one of said upright members operating on said caster assemblies adjacent said right-side upright member and said left-side upright member said brake means extending to said caster assemblies with said brake means being normally in braking position to prevent movement of said device, and actuable by said user to release about simultaneously each of said caster assemblies for rotatable movement, and adjustable tension control means associated with each of said caster assemblies and friction means for adjustably tensioning engagement of said friction means on each of said caster assemblies to ease or tighten movement each of said assemblies for permitting said user to slow down or speed up walking movement.

2. The walking stabilizer device recited in claim 1, wherein said tension control means comprises a friction device arranged adjacent said caster assembly.

3. The walking stabilizer device recited in claim 2, wherein said friction device has an adjustable lever arranged in an arcuate slot accessible to said user for selectively moving friction device to or away from the caster.

4. The device recited in claim 1, wherein a free end of said legs of said U shaped base has a projection arranged upwardly from said base adapted to lift said base upwardly when pressed downward for clearing curbs and similar obstructions.

5. The walking stabilizer device recited in claim 4, wherein said projection comprises a fulcrum accessible to said user adapted to cause lifting action by pressing on said projection.

6. The walking stabilizer device recited in claim 1, wherein a rotatable central caster is mounted medially of said base and said caster is connected to a spring assembly, said spring assembly being adjustable to tension or loosen said caster in said base.

7. The walking stabilizer device recited in claim 1, wherein connecting means is arranged intermediate the height of said upright members and bridges said upright members.

8. The walking stabilizer device recited in claim 7, wherein said connecting means carries a foldable seat adjustable in height along said upright members.

9. The walking stabilizer device recited In claim 7, wherein cables connect said brake means to said caster assembly and said cables are secured to an upright member from said brake means to said connecting means and from said connecting means to said caster assembly tension control means.

10. The walking stabilizer device recited in claim 7, wherein an upright bar is pivotally connected to said U shaped base and to said upright members, and release means connects said upright bar and said upright members midway the length of said bar and said members.

11. The walking stabilizer device recited in claim 10, wherein said release means when in one selected position secures said device upright for walking movement.

12. The walking stabilizer device recited in claim 10, wherein said release means when in one selected position permits said device to be folded and collapsed for transport and storage.

13. The walking stabilizer device recited in claim 7, wherein a brake bar bridges said upright members, and is connected to said brake means and operable to permit or prevent movement of said device.

14. The walking stabilizer device recited in claim 13, wherein a seat is secured on said upright members and said connecting means, and said brake bar is rockable on said upright members and brake mean to actuate movement of said device.

15. The device recited in claim 1, wherein said device is adapted to accommodate a user within the perimeter of said U-shaped base, and said base wheel assemblies and caster assemblies are adapted for articulatable movement of said device as desired by said user.

16. A walking stabilizer device to assist movement of a physically disable user, said device comprising: a U shaped base wheel assemblies secured on said base rotatable responsive to movement of said device by said disable person, a plurality of caster assemblies secured on opposed legs of said base for rotation in said base said caster assemblies arranged in line with said wheel assemblies in the direction of movement of said wheel assemblies, a pair of upright members, a right-side upright member and a left-side upright member, operating on said caster assemblies adjacent said right-side upright member and said left-side upright member, each extending from said base above each of said caster assemblies, said brake means on at least one of said upright members extending to said caster assemblies said brake means being normally in braking position to prevent movement of said device, and actuable by said user to release about simultaneously each of said caster assemblies for rotatable movement, and a fulcrum device upstanding on a free end of said U shaped base adapted to lift said device when depressed.

17. A walking stabilizer device to assist movement of a physically disable user, said device comprising:

a U shaped base wheel assemblies secured on said base rotatable responsive to movement of said device by said user, a plurality of caster assemblies secured on opposed legs of said base for rotation in said base said caster assemblies arranged in line with said wheel assemblies in the direction of movement of said wheel assemblies, a right-side upright member and a left-side upright member each extending from said base above said caster assemblies, brake means on at least one of said upright members operating on said caster assemblies adjacent said right-side upright member and said left-side upright member said brake means extending to said caster assemblies with said brake means being normally in braking position to prevent movement of said device, and actuable by said user to release each of said caster assemblies for rotatable movement, and adjustable tension control means associated with each of said caster assemblies and friction means for adjustably tensioning engagement of said friction means on each of said caster assemblies to ease or tighten movement of each of said assemblies for permitting said user to slow down or speed up walking movement, said brake means having brake levers normally under tension to prevent movement of said device and adapted to release about simultaneously said brake means when depressed by said user.

* * * * *